US006129474A

United States Patent [19]

Mitchell et al.

[11] Patent Number: 6,129,474

[45] Date of Patent: Oct. 10, 2000

[54] TOOTHPASTE DISPENSING TOOTHBRUSH

[75] Inventors: John R. Mitchell, Darien; Douglas J. Hidding, Barrington Hills, both of Ill.

[73] Assignee: Blackhawk Molding Inc., Addison, Ill.

[21] Appl. No.: 09/131,572

[22] Filed: Aug. 10, 1998

Related U.S. Application Data

[63] Continuation-in-part of application No. 08/963,137, Nov. 3, 1997, abandoned.

[51] Int. Cl.[7] ..... A46B 11/02

[52] U.S. Cl. ..... 401/286; 401/175; 401/288

[58] Field of Search ..... 401/175, 286, 401/287, 288

[56] References Cited

U.S. PATENT DOCUMENTS

| | | | |
|---|---|---|---|
| 642,114 | 1/1900 | Hall . | |
| 910,970 | 1/1909 | Stryker | 401/175 |
| 1,114,646 | 10/1914 | Pap | 401/175 |
| 1,340,115 | 5/1920 | Breining | 401/286 X |
| 1,486,394 | 3/1924 | Smith | 401/175 X |
| 3,039,476 | 6/1962 | Reitknecht | 132/84 |
| 3,141,465 | 7/1964 | Petropoulos | 132/84 |
| 3,728,035 | 4/1973 | Reitknecht | 401/175 |
| 4,201,490 | 5/1980 | D'Angelo | 401/175 |
| 5,066,155 | 11/1991 | English et al. | 401/175 |

FOREIGN PATENT DOCUMENTS

| | | | |
|---|---|---|---|
| 23 48 551 | 4/1975 | Germany . | |
| 35 35 342 A1 | 4/1987 | Germany . | |
| 492521 | 3/1954 | Italy . | |
| 603327 | 3/1960 | Italy . | |
| 620271 | 5/1961 | Italy | 401/175 |
| 52-51251 | 4/1977 | Japan . | |
| WO 79/00200 | 4/1979 | WIPO . | |

*Primary Examiner*—Steven A. Bratlie
*Attorney, Agent, or Firm*—Welsh & Katz, Ltd.

[57] ABSTRACT

A toothbrush and dispenser for toothpaste is provided. The toothbrush and dispenser includes an elongated one-piece handle and a plurality of substantially parallel bristles disposed along a side of the elongated one-piece handle proximate a first end orthogonal to a predominant axis of the elongated one-piece handle. The toothbrush and dispenser also includes a toothpaste reservoir disposed within the handle predominantly at a second end of the handle and a toothpaste discharge orifice disposed to discharge the toothpaste from the side of the first end of the elongated one-piece handle among the plurality of bristles. First and second substantially parallel toothpaste passageways are provided which communicates the toothpaste from the reservoir to the discharge orifice.

10 Claims, 4 Drawing Sheets

TOOTHPASTE DISPENSING TOOTHBRUSH

This is a cip of Ser. No. 08/963,137 filed Nov. 3, 1997 now abandoned.

FIELD OF THE INVENTION

The field of the invention relates to toothbrushes and more particularly to toothbrushes which have an internal reservoir of toothpaste.

BACKGROUND OF THE INVENTION

Toothbrushes with an internal supply of toothpaste are known. For example at least one prior device has a toothbrush with an internal reservoir of toothpaste hidden in the handle. An upright discharge tube among the bristles of the toothbrush is used to provide an outlet for the toothpaste. A drive screw and piston provided within the reservoir is used to force the toothpaste out through the bristles during use. A knob for turning the drive screw is provided at the base of the handle, which advances the piston against the toothpaste.

A pair of flapper valves on an end of the discharge tube preserves the freshness of the toothpaste remaining in the reservoir. The valves separates and open to allow toothpaste to flow out onto end areas of brush tufts on the brush head whenever an expressive force is applied to the toothpaste.

The handle and reservoir of such devices is detachable from the brush and is replaceable. A threaded connection is provided at the intersection of the brush and handle for separation of the brush and handle.

While the prior art devices are relatively effective, they typically require specially formulated toothpaste of reduced viscosity and resistance to drying out. They are often also expensive to manufacture and difficult to assemble. Accordingly, a need exists for a toothbrush/toothpaste dispenser which uses conventional toothpaste, is simple to use and easy to manufacture.

SUMMARY

A toothbrush and dispenser for toothpaste is provided. The toothbrush and dispenser includes an elongated one-piece handle and a plurality of substantially parallel bristles disposed along a side of the elongated one-piece handle proximate a first end orthogonal to a predominant axis of the elongated one-piece handle. The toothbrush and dispenser also includes a toothpaste reservoir disposed within the handle predominantly at a second end of the handle and a toothpaste discharge orifice disposed to discharge the toothpaste from the side of the first end of the elongated one-piece handle among the plurality of bristles. First and second toothpaste passageways are provided which communicates the toothpaste from the reservoir to the discharge orifice.

DETAILED DESCRIPTION OF AN EMBODIMENT

Figure 1:
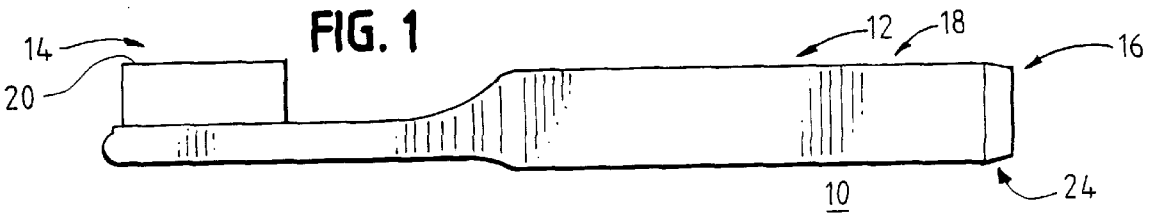
FIG. 1 depicts a side view of the toothbrush and toothpaste dispenser in accordance with an embodiment of the invention.

FIG. 1 is a side view of the toothbrush/toothpaste dispenser 10, generally, under an embodiment of the invention. Under the embodiment, the brush 10 is constructed of a one-piece body which forms a handle 12 having a brush 14 at a first end and a reservoir 18 located predominantly at a second end.

The outer walls (i.e., the barrel) of the reservoir 18 is generally cylindrical in shape and conforms generally to the shape of the second end of the handle 12. A longitudinal axis of the cylindrical reservoir may be coincident with a longitudinal axis of the brush 10.

Located on a top surface of the reservoir 18 is a flat portion 22 (FIG. 2) extending longitudinally with respect to the reservoir 18. A corresponding flat portion on an inner surface of the reservoir 18 forms a chord across a portion of the circular cross-section of the cylindrical reservoir 18 and functions to prevent rotation of a piston 26 within the reservoir 18 as it is driven along the length of the reservoir 18.

A particular feature of the brush 10 is that the reservoir 18 is specifically segregated to the second end of the handle 12. Segregating the reservoir to the second end of the handle 12 helps avoid contact between a rear surface of the brush 14 with the side teeth of a user while the user brushes his back teeth.

A knurled knob 16 is provided at the second end of the handle 14. When a user twists the knob 16, the twisting motion causes the brush 10 to dispense toothpaste from an orifice located among the bristles 20 of the brush 14.

Figure 2:
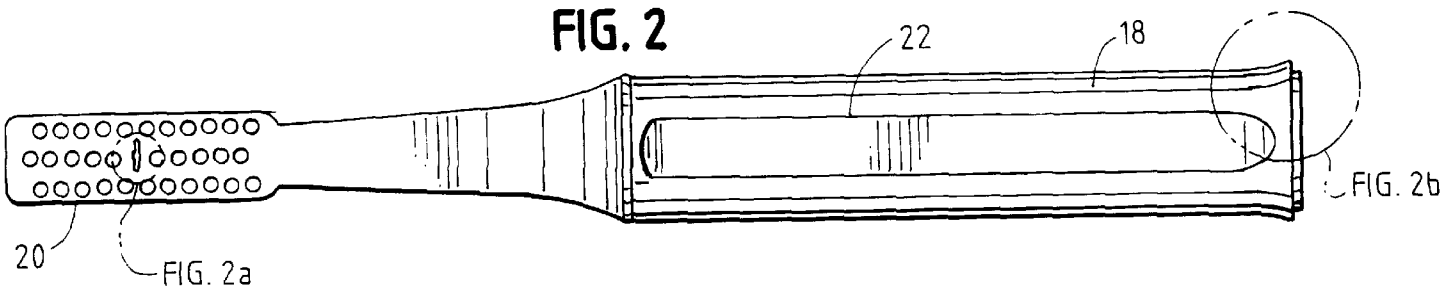
FIG. 2 depicts a top and detail view of the brush of FIG. 1.
Figure 2B:
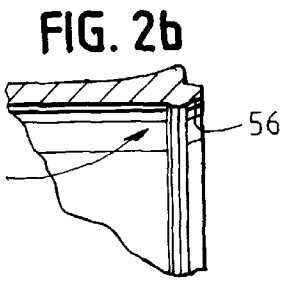
Figure 2A:
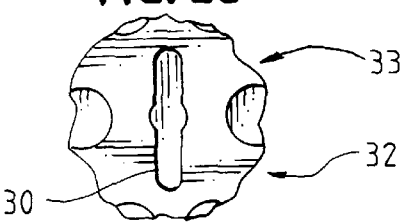
Figure 3:
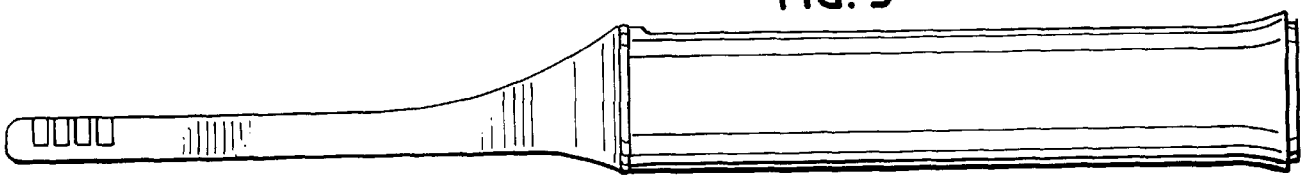
FIG. 3 depicts a side and end view of the handle of the brush of FIG. 1.

FIG. 2 is a top phantom view of the handle 12 of the brush 10. As shown, a first and second passageway 32, 33 connects a barrel of the reservoir 18 to the orifice 30. FIG. 3 is a side phantom view showing the relationship of the orifice 30 and passageways 32, 33 to the bristles 20.

It has been found that locating the orifice 30 along the base of the bristles 20 reduces irritation to the gums of a user by eliminating any possible abrasion of the gums by the upright discharge orifice used by prior art devices. It has also been found that locating the discharge orifice near the base of the bristles is more hygienically functional than prior art brushes. By eliminating moving parts, which easily clog (e.g., the flapper valves on the discharge orifice), contamination of the toothpaste is more easily avoided. The elimination of an upright tube also allows cleansing water to more easily flow through the brush 14.

Further, the use of two passageways 32, 33 has been found to be of benefit in reducing a thickness of the toothbrush 10 in the area beneath the bristles 20. Providing two passageways 32, 33 allows the passageways to be routed around and on either side of the center set of bristles, thereby avoiding those areas where the bristles must be anchored into the handle.

Figure 4A:
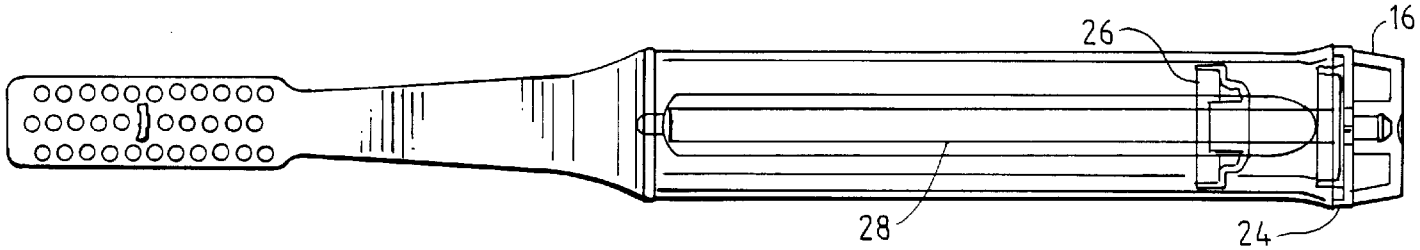
FIG. 4*a–b* depicts a cut-away assembly view of the brush of FIG. 1 with a protective cap.
Figure 4B:
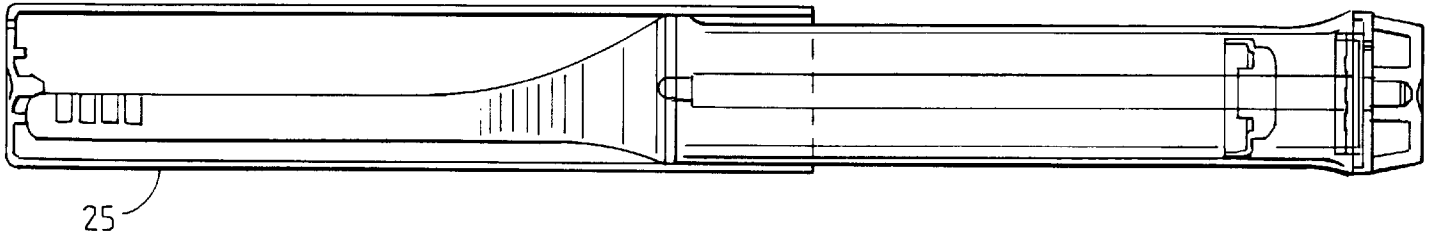
Figure 5C:
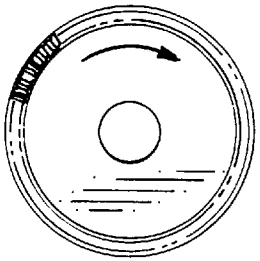
FIG. 5*a–c* depicts details of the twist knob of the brush of FIG. 1.
Figure 5B:
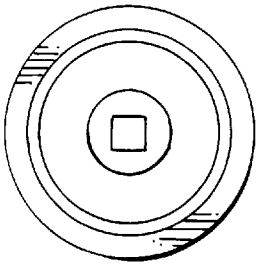
Figure 5A:
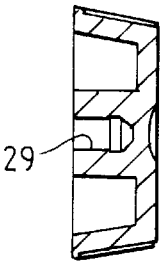
Figure 6A:
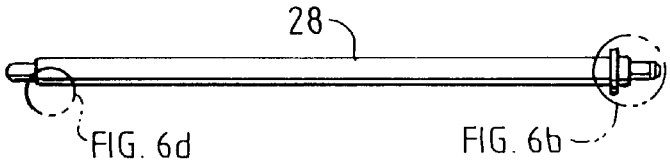
FIG. 6*a–d* depicts details of the shaft of the brush of FIG. 1.
Figure 6B:
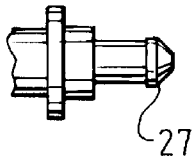
Figure 6C:
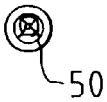
Figure 6D:
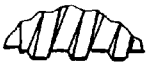
Figure 7A:
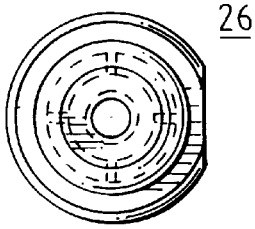
FIG. 7*a–f* depicts details of the piston of the brush of FIG. 1.
Figure 7B:
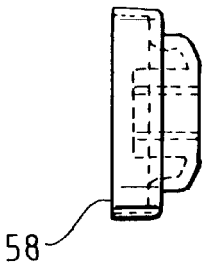
Figure 7C:
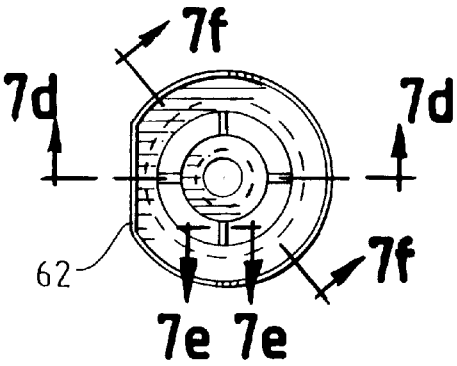
Figure 7D:
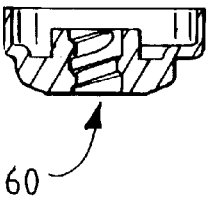
Figure 7E:
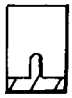
Figure 7F:
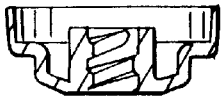

FIG. 4*a* is a cut-away top assembly view of the brush 10. As shown the knob 16 engages a threaded shaft 28 (FIG. 6)

which extends substantially the length of the barrel of the reservoir 18. The shaft 28 is provided with a square end section 50 (FIGS. 6*b–c*) on a first end of the shaft 28. The square end 50 of the shaft 28 may be used to engage a square hole in the knob 16 and may be secured by a detent 27 (FIG. 6*b*) and lip 29 (FIG. 5*a*) within the knob 16. The use of the square end 50 and square hole in the knob 16 allows the knob and threaded shaft 28 to be turned as a single assembly resulting in a reliable delivery of toothpaste through the orifice 30.

A second end of the shaft 28 may be left to float within the reservoir or a perforated stabilizer (not shown) may be used. Where a perforated stabilizer is used, an appropriate outer diameter (e.g., 0.450 inch) of the stabilizer would be provided for easy insertion into the reservoir 18. A central hole of an appropriate diameter (e.g., 0.090 inch) would be provided to receive the second end of the threaded rod 28. The inner and outer diameters may be joined by spokes which provide sufficient space between the spokes for passage of the toothpaste from the reservoir to the orifice 30.

Figure 8A:
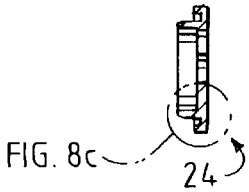
FIG. 8*a–d* depicts details of the end cap of the brush of FIG. 1.
Figure 8B:
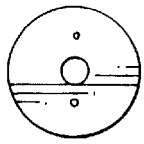
Figure 8C:
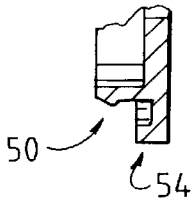
Figure 8D:
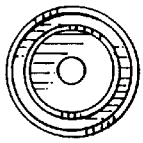
Figure 9A:
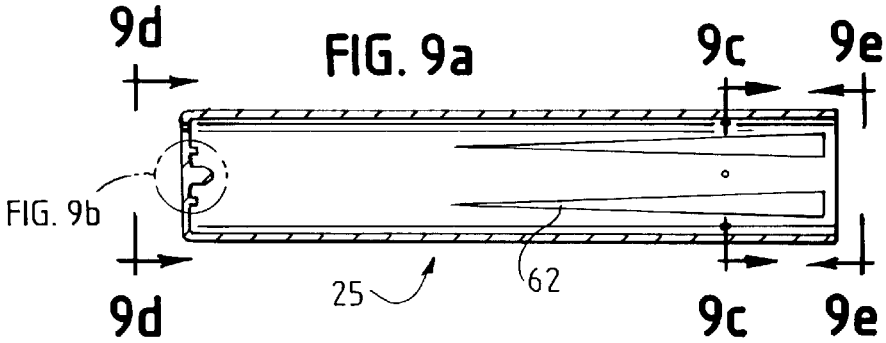
FIG. 9*a–e* depicts details of the brush cap of the brush of FIG. 4*b*.
Figure 9B:
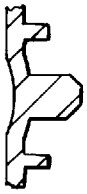
Figure 9C:
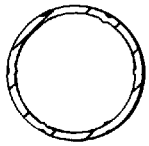
Figure 9D:
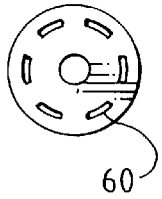
Figure 9E:
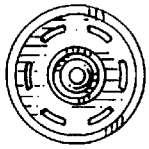

An end cap 24 (FIG. 8) is provided on the reservoir 28 between the reservoir 18 and knob 16 to seal and protect the toothpaste within the brush 10 from the outside world. A detent 50 (FIG. 8*c*) of the cap 24 engages a lip 52 (FIG. 2) of the reservoir 18. The detent 50 and lip 52 serve not only to secure the cap 24 to the barrel of the reservoir 18, but also to form a protective seal between the cap 24 and barrel. A further surrounding lip 54 of the cap 24 and projecting lip 56 of the barrel further protects the toothpaste from drying and contamination.

A hole is provided in the end cap 24 through which the shaft 28 passes. The hole is provided with a diameter (e.g., 0.145 inch) which is sufficiently close to a diameter of the rod (e.g., 0.140 inch) to also prevent drying of the toothpaste and entry of contaminants.

Engaging the shaft 28 within the reservoir 18 is a piston 26 (FIGS. 7*a–d*). The shaft 28 passes through a hole at the center of the piston 26. A leading outer lip 58 of the piston 26 is selected to be slightly larger (e.g., 0.015 inch) than the barrel of the reservoir 18. The slight oversize functions to form a tight seal around the edges of the piston thereby reducing leakage of toothpaste from around the outer edge 58 of the piston 26.

A matching set of threads 60 on an inside surface of the hole through the piston 26 engages the threads of the shaft 28. The lead of the threads has been selected at 13 threads per inch to provide a convenient volume of toothpaste without excessive twisting of the knob 16. To prevent rotation as the piston 26 moves along the barrel of the reservoir 18, a flat spot 62 is provided along an outer periphery of the piston 26 which engages a flat portion 22 (FIG. 2) along an inside longitudinal surface of the barrel of the reservoir 18.

To protect the brush 14 between periods of use, a protective cap 25 (FIG. 9) may be used with the brush assembly 10. A number of holes disposed at a closed end of the protective cap 25 allow air to freely circulate among the bristles 20.

The cap 25 provides an interference fit which secures the cap 25 to the brush 10. The interference fit may be provided by the use of a set of tapering ridges 62 disposed along an inside surface of the protective cap 25.

The one-piece construction of the handle 12 reduces air leakage, as does the relatively close tolerances of the cap 24 and pass-through of the rod 28 through the cap 24. Preservation of freshness reduces a tendency on the part of the toothpaste to harden. Reducing a tendency of the toothpaste to harden allows conventional toothpaste compositions to be used in the brush 10 without high twisting forces being applied to the knob 16.

A specific embodiment of apparatus of providing toothbrush/toothpaste dispenser according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

We claim:

1. A toothbrush and dispenser for toothpaste comprising:

an elongated one-piece handle;

a plurality of substantially parallel bristles disposed along a side of the elongated one-piece handle proximate a first end orthogonal to a predominant axis of the elongated one-piece handle;

a toothpaste reservoir disposed within the handle predominantly at a second end of the handle;

a single slotted toothpaste discharge orifice disposed across at least a center one-third of the first end perpendicular to the parallel bristles and adapted to discharge the toothpaste from the side of the first end of the elongated one-piece handle among the plurality of bristles; and first and a second, substantially parallel toothpaste passageways coupled between opposing ends of the slotted orifice and the reservoir and which communicate the toothpaste from the reservoir to the discharge orifice.

2. The toothbrush and toothbrush dispenser as in claim 1 wherein the reservoir further comprises a substantially cylindrical chamber with a longitudinal axis of the cylindrical chamber coincident with the longitudinal axis of the elongated one-piece handle and a longitudinal oriented flat portion, such flat portion forming a chord across a portion of the circular periphery of the cylinder when viewed in cross-section.

3. The toothbrush and toothbrush dispenser as in claim 2 further comprising an end cap disposed over the second end of the elongated one-piece handle and forming a cover over an open end of the cylindrical chamber.

4. The toothbrush and toothbrush dispenser as in claim 3 wherein an outer mating portion of the end cap further comprises an interference fit with the open end of the cylindrical chamber.

5. The toothbrush and toothbrush dispenser as in claim 4 further comprising a moveable piston disposed within the cylindrical chamber between the cap and toothpaste which urges the toothpaste through the toothpaste passageways to the orifice and which has at least a ten degree flare in diameter towards a side facing the toothpaste.

6. The toothbrush and toothbrush dispenser as in claim 5 further comprising a threaded rod with a first end of the rod protruding through an aperture in the end cap.

7. The toothbrush and toothbrush dispenser as in claim 6 wherein the moveable piston further comprises a threaded aperture which engages the threaded rod.

8. The toothbrush and toothbrush dispenser as in claim 7 wherein the threaded rod protruding through the end cap further comprises a knurled knob which is used to turn the threaded rod.

9. The toothbrush and toothbrush dispenser as in claim 8 wherein the moveable piston further comprises a mating flat portion on an outer periphery of the moveable piston which mates with the longitudinal flat portion of the cylindrical chamber thereby preventing rotation of the moveable piston.

10. The toothbrush and toothbrush dispenser as in claim 8 further comprising a cover which encloses and protects the brush during periods of non-use.

* * * * *